US005139074A

United States Patent [19]

Warner

[11] Patent Number: 5,139,074

[45] Date of Patent: Aug. 18, 1992

[54] INDUSTRIAL DOOR HAVING FLEXIBLE AND RELEASABLE BEAM

[75] Inventor: Robert J. Warner, Mukwonago, Wis.

[73] Assignee: Kelley Company Inc., Milwaukee, Wis.

[21] Appl. No.: 679,770

[22] Filed: Apr. 3, 1991

[51] Int. Cl.[5] ..... E06B 9/17

[52] U.S. Cl. ..... 160/271; 160/265; 160/310

[58] Field of Search ..... 160/280, 281, 271, 265, 160/268.1, 272, 267, 267.1, 264, 270, 274, 133

[56] References Cited

U.S. PATENT DOCUMENTS

| | | | |
|---|---|---|---|
| 2,428,170 | 9/1947 | McDonald | 160/281 |
| 4,478,268 | 10/1984 | Palmer | 160/272 X |
| 4,800,946 | 1/1987 | Rosenoy | 160/264 |
| 5,056,579 | 10/1991 | Krafutler | 160/271 |

FOREIGN PATENT DOCUMENTS

| | | | |
|---|---|---|---|
| 0271779 | 6/1969 | Fed. Rep. of Germany | 160/267.1 |
| 264999 | 2/1977 | United Kingdom | 160/274 |

*Primary Examiner*—Blair M. Johnson

*Attorney, Agent, or Firm*—Andrus, Sceales, Starke & Sawall

[57] ABSTRACT

An industrial door includes a door panel that is movable between an open position and a closed position where the door panel encloses a doorway. A flexible beam is attached to the lower edge of the door panel and the beam is composed of superimposed strips of resilient material, such as rubber, with flexible metal strips disposed between adjacent resilient strips. Each end of the beam is provided with a longitudinal open-ended slot and an extension of a guide member is mounted within each slot in a manner such that the extensions will freely slide in the slots in a direction parallel to the plane of the door panel and will be released from the slots if the beam is subjected to a substantial accidental impact.

24 Claims, 1 Drawing Sheet

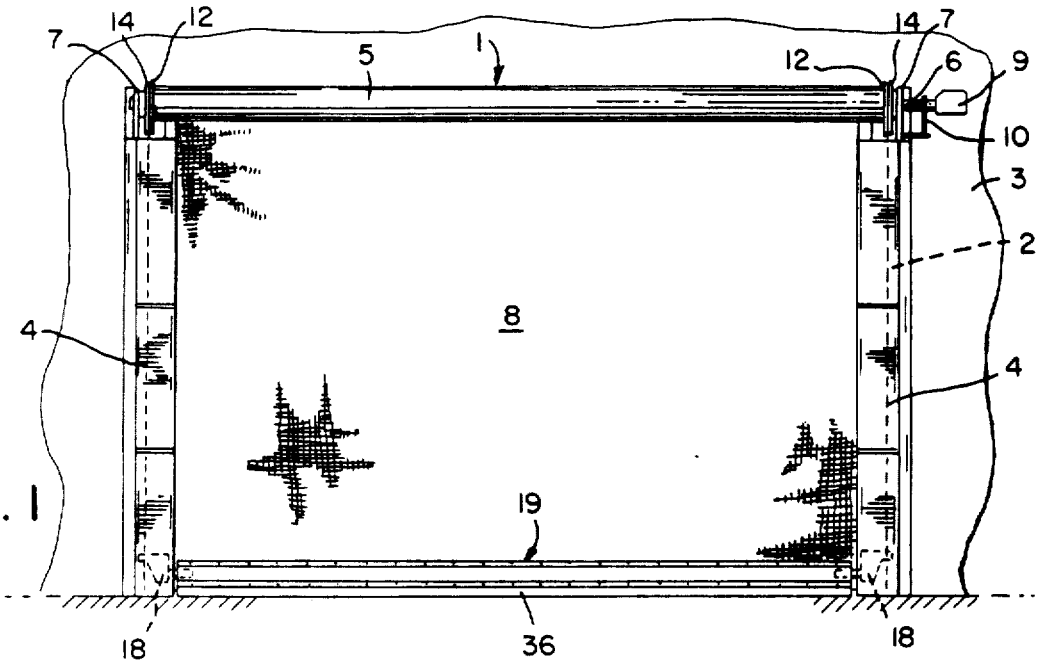
FIG. 1
FIG. 2
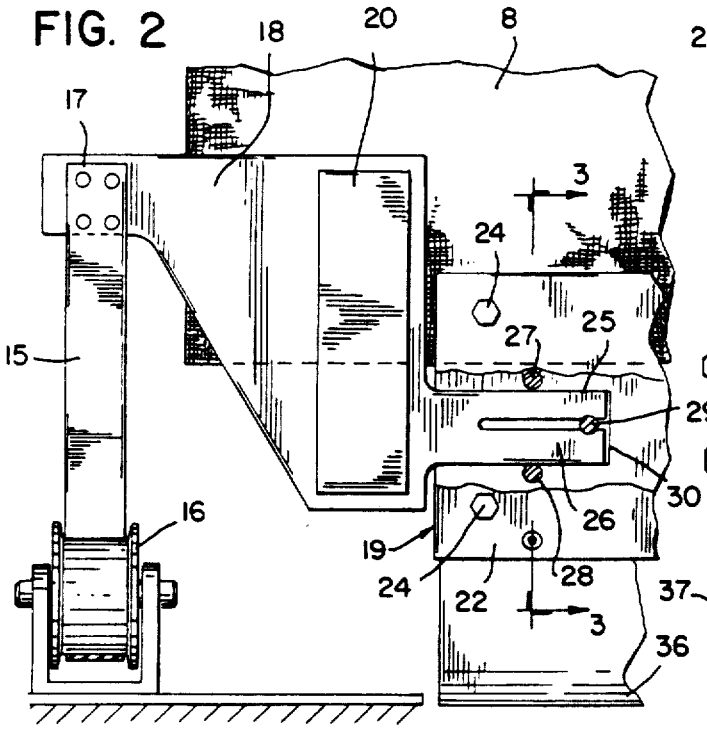
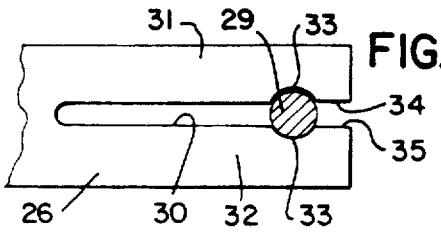
FIG. 4
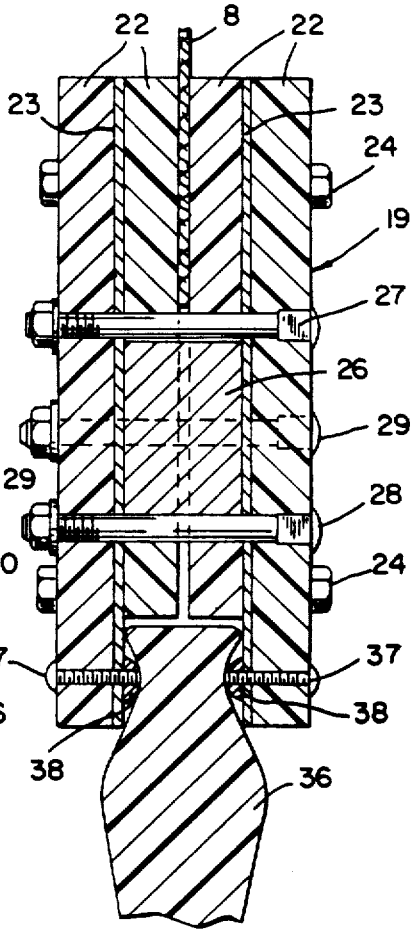
FIG. 3

INDUSTRIAL DOOR HAVING FLEXIBLE AND RELEASABLE BEAM

BACKGROUND OF THE INVENTION

Industrial doors are used in commercial or industrial buildings to separate two zones of different ambient conditions. For example, industrial doors may be used to separate two zones which have different temperature or humidity conditions, or to provide noise control between two zones and have the advantage of being moved rapidly between the open and closed positions.

In a typical roll-up door, as described in U.S. Patent Application Ser. No. 07/371,264, Filed June 26, 1989, a flexible door panel is wound on a drum located above the doorway in the building and is moved between a rolled open position and an unrolled closed position by a hydraulic motor which is operably connected to the drum. As disclosed in the aforementioned patent application, a counter balancing mechanism, such as a counterweight, is attached through a first belt and pulley arrangement to the drum and exerts a force on the drum in a direction to wind the door panel on the drum. In addition, a second belt and pulley arrangement is also secured to the drum and includes a resilient member, such as a spring, which is arranged to exert a force on the door panel to stretch the door panel at all positions.

The conventional roll-up door includes a rigid horizontal beam, formed of metal, which is attached to the lower edge of the flexible door panel. The operation of the roll-up door is normally initiated by the operator of a fork lift truck, either by the operator pulling on a suspended cable, or by the fork lift truck passing over a floor treadle. In case of a power failure, or in a situation where the fork lift operator may not fully actuate or pull the cable, or in the event the fork lift operator does not properly judge the speed of the fork lift with the opening rate of the door, the fork lift truck may engage the door panel and beam with substantial impact. The impact can bend or deform the beam, or rip the fabric door panel away from the beam, or damage the guide mechanism in the side frames of the door. As the conventional beam is formed with a non-uniform cross section, a bent or deformed beam will normally retain its bent configuration and therefore cannot readily be bent back to its original configuration.

Because of this problem, it has been proposed to incorporate a breakaway mechanism with the rigid beam on a roll-up door. A typical breakaway mechanism has included a projection or extension on the side guides which are received within slots in the end of the rigid beam. In one form, each extension has a T-shape and the beam end has a mating "T"-shaped slot. This construction will transmit vertical force but will release if the beam is subjected to a transverse force or impact. In another form, the extensions are maintained within the slots in the beam end by a ball and detent arrangement which will permit transverse release if the beam is subjected to a substantial external impact.

While breakaway devices of this type protect the door and rigid beam against a major or substantial impact, it has been found that they tend to release or break away too easily, meaning that the mechanism may release under high wind pressure or under a minor external bump. This type of release is an annoyance in that it is time consuming and requires a workman to manually re-engage the guides with the beam ends.

SUMMARY OF THE INVENTION

The invention is directed to an industrial door, such as a roll-up door, having a flexible and releasible beam. The roll-up door comprises a drum which is mounted above a doorway in a building and one end of a flexible door panel is secured to the drum and on rotation of the drum, can be moved between rolled open position and an unrolled closed position where the door panel encloses the doorway.

The beam of the invention, which is attached to the lower edge of the door panel, includes a plurality of superimposed resilient strips, formed of rubber or rubber-like material, and a strip of a hard, yet flexible material, such as metal, is positioned between adjacent resilient strips. A series of bolts serve to connect the strips in superimposed side-by-side relation.

Each end of the beam is formed with an openended slot or recess and, an extension on each side guide, which is mounted for vertical sliding movement within a guide track in the side frame of the door, is received within the slot. The guide extensions are freely slidable in the slots in the plane of the door panel and beam. Rigid members border the upper and lower edges of each slot and serve to transmit vertical forces between the guide extensions and the flexible beam.

With the flexible nature of the beam, a minor bump against the beam will merely flex the beam and move the guide extensions longitudinally in the slots, but without releasing the guide extensions from the slots. Due to its flexible nature, the beam will spring back to its original condition and the guide extensions will return to their original position in the slots. On the other hand, if the beam is subjected to a substantial external impact, the beam will initially bow or deflect, and continued deformation of the beam will release the guide extensions from the beam ends, with the release action being longitudinally of the beam or in the plane of the door panel, to prevent damage to the beam, door and guides. Thus, the release mechanism of the invention will accommodate minor bumps without releasing and yet will readily release if the door and beam is subjected to a substantial impact.

As a further advantage, the resilient strips provide an outer surface for the beam which will resist abrasion and deformation so that the beam will maintain an attractive appearance throughout its service life.

With the construction of the invention there are no air gaps at the ends of the beam so that the temperature or humidity differentials on opposite sides of the door can be maintained.

Other objects and advantages will appear in the course of the following description.

DESCRIPTION OF THE DRAWINGS

FIG. 1 is a front elevation of a roll-up door incorporating the breakaway beam construction of the invention;

FIG. 2 is an enlarged fragmentary front elevation with parts broken away showing the connection of a side guide to the beam end;

FIG. 3 is a section taken along line 3—3 of FIG. 2; and

FIG. 4 is an enlarged fragmentary plan view of a guide extension.

DESCRIPTION OF THE ILLUSTRATED EMBODIMENT

The drawings illustrate a roll-up door 1 which is adapted to enclose a doorway 2 in a commercial or industrial building 3.

Door 1 includes a pair of generally boxed-shaped vertical frame members 4 which are located along the sides or jambs of doorway 2. A cylindrical drum 5 is mounted horizontally above doorway 2 and a shaft 6 projects axially from each end of the drum and is journaled within bearings 7 that are mounted on the upper end of each frame member 4.

A flexible door panel 8 has one end secured to the outer surface of drum 5 and is adapted to be wound and unwound from the drum. In the unwound condition, panel 8 extends downwardly and encloses doorway 2 as shown in FIG. 1. Door panel 8 is preferably formed of fabric and is coated with a plastic material, such as polyvinylchloride, or the like.

Door panel 8 can be wound and unwound on drum 5 by a mechanism as disclosed in U.S. Patent Application Ser. No. 07/371,264, filed June 26, 1989, now U.S. Pat. No. 5,048,588. In addition, the door can include a counterbalancing mechanism and a spring tensioning system as described in the above patent application. More particularly, to rotate drum 5 and thereby roll and unroll the door panel 8, a hydraulic motor 9 is connected to one end of shaft 6 through a disc brake mechanism 1. Operation of motor 9 in one direction will cause the panel 8 to unwind from the drum 5, while rotation of the motor in the opposite direction will wind the door panel on the drum. Brake 10 is constructed so that it will be in a disengaged condition when the motor 9 is operating and will automatically be engaged when operation of the motor is terminated so that the brake will then hold the door panel 8 in any given position.

A pulley 12 is secured to each end of drum 5 and a generally flat belt, having a greater width than thickness, is adapted to be wound in overlapping turns on each pulley 12. One end of each belt is secured to the respective pulley and the belt is then trained over a group of pulleys, not shown, and is dead-ended on frame 4. A counter balancing weight, as described in the aforementioned patent application, can be connected to the belt and pulley arrangement and exerts a force tending to rotate the pulley 12 and drum 5 in a direction to roll the door panel 8 on the drum, thus serving to counterbalance the weight of the door panel.

In addition to the counter balancing system, a separate tensioning system for the door panel 8 can be incorporated. The spring tensioning system includes a pair of pulleys 14, each of which is mounted to the drum shaft along side a pulley 12, and a belt 15 is wound on each pulley 14. As disclosed in the aforementioned patent application, the tensioning belts 15 are trained over a series of pulleys (not shown) and a spring is associated with each belt and pulley arrangement and the spring exerts a downward force on the door panel when it is in the unrolled condition to stretch the door panel and resist wind deflection.

As shown in FIG. 2, each belt 15 passes around a pulley 16 which is mounted on the ground or foundation and the end of the belt is dead ended, as indicated at 17, on a guide 18. Guides 18 are connected to the ends of a beam 19 that is secured to the lower edge of door panel 8. One surface of each guide 18 is provided with a wear pad 20 which rides against the surface of a guide track in side frame 4 as the door panel 8 is rolled and unrolled.

The construction of beam 19 is best illustrated in FIG. 3 and includes a series of resilient strips 22 formed of rubber or a rubber-like material. While the drawings illustrate four strips 22 being utilized, it is contemplated that any number of strips may be employed. Located between adjacent resilient strips 22 are hard flexible strips 23, preferably formed of sheet steel.

To secured beam 19 to door panel 8, the lower edge of the door panel is received between the two innermost resilient strips 22. Strips 22 and 23 are secured together in superimposed relation by a plurality of bolts 24.

With the construction as described above, beam 19 is flexible and the stiffness of the beam can be varied, by varying the thickness of the steel strips 23, by varying the spacing between strips 23 or by changing the torque on the bolts 24.

The outer resilient strips 22 prevent abrasion and will resist denting or deformation while the inner strips 22 serve as spacers for the steel strips 23 and thereby determine the stiffness of the beam.

Each end of beam 19 is formed with an open ended slot or recess 25. To form the slot 25, portions of the ends of the inner resilient strips 22 have a shorter length than the outer resilient strips and the steel strips 23. An end or extension 26 of each guide 18 is received within the respective slot 25. To transmit vertical forces between the guide extensions 26 and beam 19, rigid force transmitting members are located on the upper and lower sides of each slot 25. As illustrated the rigid members comprise a group of fasteners, such as bolts. More specifically, a bolt 27 extends through aligned openings in strips 22 and 23 and is located immediately above each slot 25 and guide end 26. Similarly, a bolt 28 extends through aligned holes in strips 22 and 23 and is located beneath each slot 25. In addition, a third bolt 29 extends through aligned holes in strips 22 and 23 and is located within a slot or notch 30 formed in the end of each guide extension 26, as shown in FIG. 2. With this construction, the bolts 27–29 will transmit vertical forces between the guides 18 and beam 19 but will permit release of the guide extensions 26 from slots 25 if the beam is subjected to a substantial impact.

As best shown in FIG. 4, slot 30 divides the extension 26 into two sections 31 and 32, and the facing edges of sections 31 and 32 are formed with curved or arcuate recesses 33 which receive bolt 29. When a substantial impact is applied to the door panel 8 or beam 19, bolts 29 will tend to move toward the open end of the respective slot 30, wedging sections 31 and 32 apart to release the bolt 29 from the extension 26. The release action can be controlled by varying the thickness or height of the sections 31,32, or by varying the distance between edges 34 and 35, as seen in FIG. 4.

While the drawings illustrate the vertical force transmitting members as bolts 27–29, it is contemplated that the other structures can be utilized, such as metal plates which border the upper and lower ends of slot 25 or a pre-formed U-shaped metal insert can be located within the slot 25.

A resilient bumper 36, formed of a material such as rubber or plastic, is connected to the lower end of the beam. To connect the bumper to the beam, screws 37 extend through aligned holes in the outer strips 22 and through strips 23 and the inner ends of screws carry half rounds 38 which are engaged with the neck 39 of the bumper. A fabric cover, not shown, can be positioned around the bumper, is desired.

Beam 19 is flexible in a horizontal direction and is capable of deflecting up to about three inches without release of the beam from the guide extensions 26. If the door is subjected to a minor transverse impact, the beam will bend or deflect, causing bolts 29 to disengage from recesses 33 in slot 30, and in some cases bolts 29 will move out of the open ends of slots 30. Due to the flexible nature of strips 22 and 23, the beam will spring back to its original configuration after the minor impact and bolts 29 will automatically re-engage with recesses 33 in slot 30. On the other hand, if the beam is subjected to a impact of substantial force, guide extensions 26 will be released from slots 25, with the release motion being in the longitudinal direction of the beam or in the plane of the door panel 8, to prevent permanent damage to the beam 19 and the door panel 8, as well as the guide mechanism. Thus, the beam construction of the invention will accommodate minor bumps or impacts without release, and yet will readily release if the beam is subjected to a substantial impact.

If the beam is subjected to a very substantial impact, the steel plates may be bent to a point where they will not spring back to their original configuration. Due to the fact that the beam, as well as its components, have a uniform cross section throughout their length, the beam can be readily re-bent to its original configuration by manual force and without the need of auxiliary equipment.

The beam of the invention allows the door to directly resist uniform transverse loads, such as that caused by wind force, without release.

The drawings show the beam construction associated with a roll-up door, but the beam can also be incorporated with other types of industrial doors, such as folding or sliding doors.

As a further advantage, there are no air gaps at the ends of the beam so that the door, when in the closed position, will prevent air leakage between opposite sides of the door and maintain the desired conditions on opposite sides of the door.

Various modes of carrying out the invention are contemplated as being within the scope of the following claims particularly pointing out and distinctly claiming the subject matter which is regarded as the invention.

I claim:

1. A flexible releasible beam construction for an industrial door with guide tracks, comprising a door panel movable between an open position and a closed position where the door panel encloses a doorway in a building, a flexible beam attached to the lower edge of the door panel and being resiliently flexible in a direction transverse of the plane of the closed door panel, guide means releasably connected to at least one end of the beam for guiding the door panel in the guide tracks as the door panel is moved between the open and closed positions, said beam comprising a plurality of generally flat resilient strips disposed in side-by-side relation, said one end of the beam having an open-ended slot to receive said guide means, said guide means being freely slidable in said slot in a direction generally parallel to the longitudinal dimension of said beam when said beam flexes in said transverse direction due to a substantial transverse impact to permit said guide means to be released from said slot.

2. The beam construction of claim 1, wherein said slot is bordered by an upper edge and a lower edge, said construction also including force transmitting means disposed on the upper and lower edges to transmit vertical forces between said guide means and said beam.

3. The beam construction of claim 2, wherein said force transmitting means comprises rigid metal members.

4. The beam construction of claim 3, wherein said metal members comprise fastener means connecting said strips together in side-by-side relation.

5. The beam construction of claim 4, wherein said fastener means includes a plurality of fasteners extending transversely through said strips, a first of said fasteners disposed immediately above said slot and a second of said fasteners disposed immediately below said slot.

6. The beam construction of a claim 5, wherein said guide means includes a section disposed in said slot, the inner end of said section has a notch and a third of said fasteners is disposed in said notch.

7. The beam construction of claim 1, wherein said beam also includes a pair of flexible hard sheets, each sheet disposed between a pair of adjacent resilient strips, said sheets bordering said open-ended slot.

8. The beam construction of claim 1, wherein the lower edge of said door panel is secured between a pair of adjacent resilient strips.

9. The beam construction of claim 1, wherein said resilient strips are formed of rubber.

10. An industrial door construction, comprising a door movable between a closed position when the panel encloses a doorway to an open position, a resiliently flexible beam member fixedly connected to an edge portion of the door and being flexible in a direction transverse of the plane of the door, a guide member for guiding the door in guide tracks in movement between said closed and open positions, and connecting means for releasably connecting said guide member and an end of said beam member, said connecting means being constructed and arranged to effect relative movement between said beam member and said guide member in a direction generally parallel to the longitudinal dimension of the beam member when said beam member is subjected to a predetermined external transverse force to thereby release the connection between said beam member and said guide member.

11. An industrial door construction, comprising a door movable between an open position and a closed position where said door encloses a doorway, a guide track mounted along each side of the doorway, a guide member mounted for movement in each guide track, each guide member having an extension projecting inwardly toward the center of said door panel from the respective guide track, and a flexible elongated beam connected to the lower edge of the door, each end of the beam having an open-ended slot to receive the respective extension, each extension being freely slidable in the respective slot to permit said beam to be released from said extension when said beam flexed due to a predetermined external transverse impact.

12. The door construction of claim 11, and including a first rigid member connected to said beam and located immediately above said slot, and a second rigid member connected to said beam and located immediately beneath said slot.

13. The beam construction of claim 12, wherein each guide means has a distal end disposed in the respective slot, each distal end having an open ended notch, and said door construction also includes a third rigid member connected to said beam and disposed within said notch.

14. The beam construction of claim 13, wherein said rigid members are bolts that extend transversely through the beam.

15. The door construction of claim 11, wherein said beam includes a plurality of superimposed resilient strips, and a flexible hard strip located between each pair of adjacent resilient strips, said flexible hard strips being spaced transversely apart.

16. The beam construction of claim 15, wherein said flexible hard strips are composed of metal.

17. The door construction of claim 13, wherein said notch is elongated and is bordered by a pair of spaced longitudinal edges, at least one of said edges having a pocket to receive said third rigid member.

18. The door construction of claim 17, and wherein both edges have a pocket, said pockets being aligned and spaced from said distal end.

19. The door construction of claim 18, wherein the portion of each edge, extending from the pocket to the distal end comprises a lip, the spacing between the lips acting to control the release of said third rigid member from said elongated notch when said beam is subjected to said transverse impact.

20. An industrial door construction, comprising a drum mounted above a doorway in a building, a flexible door panel wound on said drum and movable between a rolled position and an unrolled position where said door panel encloses said doorway, drive means for moving said door panel between the rolled and unrolled positions, a guide member mounted for movement along each side of the doorway, and a flexible beam connected to said guide members, said beam including four resilient strips disposed in superimposed relation and including a pair of inner strips and a pair of outer strips, the lower edge of said door panel being disposed between said inner strips, a flexible thin sheet of relatively hard material disposed between each inner strip and the adjacent outer strip, and a plurality of fasteners extending transversely through aligned holes in said strips and said sheets, the ends of said inner strips terminating short of the ends of said outer strips to provide an open-ended slot in each end of the beam, each guide member being disposed within a corresponding slot, said fasteners including a first fastener disposed immediately above each slot, a second fastener disposed immediately beneath each slot and a third fastener disposed within a notch in the distal end of the respective guide, member.

21. The beam construction of claim 20, wherein said sheets are formed of metal and border said slots.

22. A flexible releasible beam construction for an industrial door with guide tracks, comprising a door panel movable between an open position and a closed position when the door panel encloses a doorway in a building, a flexible beam attached to the lower edge of the door panel, guide means releasably connected to at least one end o the beam for guiding the door panel in the guide tracks as the door panel is moved between the open and closed positions, said beam comprising a plurality of resilient strips disposed in side-by-side relation and further including a flexible hard sheet of material disposed between a pair of adjacent resilient strips, said one end of the beam having an open ended slot to receive said guide means, said guide means being freely slidable in said slot in a direction generally parallel to the longitudinal dimension of said beam to permit said guide means to be released from said slot when said beam is subjected to a substantial transverse force.

23. An industrial door construction, comprising a flexible door movable between an open position and a closed position where said door encloses a doorway in a building, a guide track mounted along each side of the doorway, a guide member mounted for movement in each guide track, a flexible elongated beam connected to the lower edge of the door, each end of the beam having an open-ended slot facing toward the respective guide track, each guide member having an extension projecting inwardly toward the center of said door from the respective guide track and disposed within the respective open ended sot, each extension being freely slidable in the respective slot, and means for preventing transverse disengagement of each extension from the respective slot, transverse flexing of said beam when said beam is subjected to a substantial transverse force causing at least one of said extensions to be released longitudinally from the respective slot.

24. An industrial door construction, comprising a door movable between an open position and a closed position where said door encloses a doorway, a guide track mounted along each side of the doorway, a guide member mounted for movement in each guide track, and an elongated beam member connected to the lower edge of the door, said beam member being flexible in a transverse direction, one of said members having an open-ended slot, said slot having an open end facing the other of said members, said other member having an extension slidably disposed in said slot, said slot and said extension being constructed and arranged to enable said beam member to be released from said guide member when said beam member flexes due to a predetermined external transverse impact.

* * * * *

UNITED STATES PATENT AND TRADEMARK OFFICE

CERTIFICATE OF CORRECTION

PATENT NO. : 5,139,074

DATED : August 18, 1992

INVENTOR(S) : ROBERT J. WARNER

It is certified that error appears in the above-identified patent and that said Letters Patent is hereby corrected as shown below:

Col. 6, Line 15, CLAIM 6, After "of" delete "a"; Col. 6, Line 30, CLAIM 10 Cancel "when" and substitute therefor --where--; Col. 6, Line 58, CLAIM 11, Cancel "flexed" and substitute therefor --flexes--; Col. 7, Line 49, CLAIM 21, After "guide" delete "," (comma); Col. 8, Line 7, CLAIM 22, Cancel "o" and substitute therefor --of--; Col. 8, Lines 30, CLAIM 28, Cancel "sot" and substitute therefor --slot--

Signed and Sealed this

Eleventh Day of January, 1994

*Attest:*

Bruce Lehman

BRUCE LEHMAN

*Attesting Officer*

*Commissioner of Patents and Trademarks*